US005413507A

United States Patent [19]

Sawada

[11] Patent Number: 5,413,507

[45] Date of Patent: May 9, 1995

[54] HIGH DENSITY MULTI-POLE CONNECTOR

[75] Inventor: Yoshitsugu Sawada, Shizuoka, Japan

[73] Assignee: Yazaki Corporation, Japan

[21] Appl. No.: 183,326

[22] Filed: Jan. 19, 1994

[30] Foreign Application Priority Data

Jan. 20, 1993 [JP] Japan ..... 5-7323

[51] Int. Cl.[6] ..... H01R 13/502

[52] U.S. Cl. ..... 439/701; 439/362

[58] Field of Search ..... 439/359, 362, 364, 374, 439/598, 599, 638, 686, 695, 701

[56] References Cited

U.S. PATENT DOCUMENTS

| | | | |
|---|---|---|---|
| 4,780,090 | 10/1988 | Sugiyama et al. | 439/247 |
| 4,923,411 | 5/1990 | Hayashi et al. | 439/638 X |
| 5,281,161 | 1/1994 | Kanai | 439/701 X |
| 5,312,268 | 5/1994 | Sumida | 439/701 X |

FOREIGN PATENT DOCUMENTS

| | | |
|---|---|---|
| 62-145671 | 6/1987 | Japan . |
| 63-3075 | 1/1988 | Japan . |
| 2-41827 | 11/1990 | Japan . |
| 3-226978 | 10/1991 | Japan . |

*Primary Examiner*—Khiem Nguyen

*Attorney, Agent, or Firm*—Wigman, Cohen, Leitner & Myers

[57] ABSTRACT

In a high density multi-pole connector composed of a male connector (21) having a plurality of terminal accommodating chambers and a female connector (41) also having a plurality of terminal accommodating chambers, at least one of the male and female connectors (21, 41) is divided into a plurality of separate connector housings (23, 43); and the separate connector housings are coupled to one another with a coupling block (22, 42) provided with coupling structures (28, 49) formed on both the separate connector housings (23, 43) and the coupling block (22, 42) respectively, for removably coupling the coupling block with the separate connector housings. In the high density multi-pole connector, it is possible to freely increase the number of terminals and modify the terminal arrangement positions within the connector housings; that is, various connectors of any sizes can be assembled with the use of the common coupling block (22, 42).

9 Claims, 12 Drawing Sheets

HIGH DENSITY MULTI-POLE CONNECTOR

BACKGROUND OF THE INVENTION

1. Field of the Invention

The present invention relates to a high density multi-pole connector suitable for use in an automotive vehicle, for instance.

2. Description of the Related Art

In the wire harness used for an automotive vehicle, for instance, the number of wires of the wire harness is increasing more and more with the advance with the diversification of various electric and electronic appliance. Consequently, the number of connectors used to connect a plurality of wire harnesses to one another or to connect a wire harness to various electric appliances has been increased more and more. However, when the number of the connectors increases excessively, it takes much time and requires much labor in order to connect only the connectors with one another.

To overcome the above-mentioned problem, a high density multi-pole connector in which a great number of terminals are arranged at high density is usually used in order that a great number of terminals can be connected electrically by only a single connector coupling action. As the conventional high density multi-pole connectors as described above, a high density multi-pole connector of bolt fastened type is so far well known. This conventional high density multi-pole connector is composed of male and female connectors each having a plurality of terminal accommodating chambers, and the male and female connectors are coupled to each other by use of a pair of bolt and nut each provided for either of the male connector or the female connector, respectively and by the aid of a fastening tool.

In a first example of the bolt fastened type high density multi-pole connector as disclosed in Japanese Published Unexamined Utility Model Application No. 63-3075, a male connector is composed of a frame-shaped casing having a plurality of cavities therein, a bolt attached at the center of the casing, and a plurality of male connector housings having a plurality of male terminal accommodating chambers and formed separately form the casing. On the other hand, a female connector is composed of a plurality of female connector housings having a plurality of female terminals, and a nut attached at the center of the connector housings. The separately formed male connector housings are fitted into the cavities of the casing, and the male connector is fastened to the female connector by fastening the bolt of the male connector to the nut of the female connector.

In this first conventional high density multi-pole connector, since the outer dimensions of frame-shaped casing of the male connector are fixedly determined, it is impossible to connect a large-shaped male connector having an increased number of male terminals. Further, when the number of the male terminals is reduced, the cavities of the male connector cannot be used effectively. That is, since the number of the male terminals is fixedly determined, it is impossible to increase or decrease the number of terminals freely and effectively.

In a second example of the bolt fastened type high density multi-pole connector as disclosed in Japanese Published Unexamined Patent Application No. 3-226978, a female connector is composed of a base female connector housing provided with a nut at the center thereof, and a plurality of other side female connector housings slidably engaged with the base female connector housing in the transverse direction of the base female connector so as to be locked with one another by locking portions formed on side surfaces of the base connector housing and on the side surfaces of the sides female connector housings. In this case, the base female connector housing and the other side female connector housings are further fastened with one another with the use of another separate locking member.

In the above-mentioned second conventional high density multi-pole connector, although it is possible to increase and decrease the number of the terminals somewhat freely, since the number of the terminals and the arrangement positions of the terminals are both fixedly determined, it is still impossible to freely change the number of the terminals. In addition, when the terminals are inserted into the base and side female connector housings automatically, it is necessary to limit the outer size or dimensions of the connector housings within a predetermined range, respectively. In this case, however, since the nut is provided for the base female connector housing, the size is inevitably increased.

SUMMARY OF THE INVENTION

With these problems in mind, therefore, it is the primary object of the present invention to provide a high density multi-pole connector, in which the number of the terminals and the arrangement positions of the terminals can be determined freely without any restrictions, and in addition the insertion of the terminals into the connector housings can be easily automated.

To achieve the above-mentioned object, the first aspect of the present invention provides a high density multi-pole connector comprising: a male connector (21) composed of a plurality of separate male connector housings (23) each formed with a plurality of terminal accommodating chambers; a female connector (41) formed with a plurality of terminal accommodating chambers; a male coupling block (22) for coupling a plurality of the separate male connector housings (23) of said male connector integral with one another; coupling means (28) provided for both said separate male connector housings (23) and said male coupling block (22) respectively, for removably coupling said coupling block with the separate male connector housings (23) in an engagement direction between both; and mechanical fastening means (34, 55) provided for both said female connector (41) and said coupling block respectively, for fastening said coupling block to said female connector.

Here, the coupling means (28) comprises: slidable engaging means (29, 31, 36) provided for both said male coupling block (22) and said male connector housings (23), for slidably engaging said male coupling block (22) with said male connector housings (23), respectively; and locking means (30, 32, 39) provided for both said male coupling block (22) and said male connector housings, for locking said male coupling block (22) with said male connector housings, respectively.

The slidable engaging means comprises: a plurality of slide grooves (slidable engaging means) (29) formed in two opposing outer surfaces of said coupling block, respectively so as to extend in an engagement direction between said coupling block and said male connector housings; a plurality of engage walls (31) also formed on the two opposing outer surfaces of said coupling block, respectively so as to extend in the engagement direction between both; a plurality of arms (36) formed on an inner surface of each of said male connector housings (23), respectively so as to extend in the engagement direction between both, said arms (26) being slidably engaged with said slide grooves (29) in contact with said engage walls, respectively.

The locking means comprises: a plurality of flexible locking levers (30) each formed with a projection at each free end thereof and formed on two opposing outer surfaces of said male coupling block (22), respectively so as to extend in the engagement direction between both; a plurality of stopper plates (32) formed at both ends of a bottom surface of said male coupling block (22), respectively; a plurality of arms (36) each formed with a locking hole (39) at an end thereof and formed on an inner surface of each of said male connector housings (23), respectively so as to extend in the engagement direction between both; and the projections of said flexible locking levers (30) of said male coupling block (22) being engaged with the locking holes (39) of said arms (36) of said male connector housings (23) and end surfaces of said arms of said connector housings being brought into contact with said stopper plates (32) of said male coupling block (22), respectively.

Further, in another embodiment of the present invention, the slide engaging means comprises: a plurality of guide blocks (73) formed on two opposing outer surfaces of said male coupling block (22), respectively so as to extend in an engagement direction between said coupling block and said male connector housings; and a plurality of guide receive projections (82) formed on an inner surface of each of said male connector housings (23), respectively so as to extend in the engagement direction between both, said guide blocks (73) of said male coupling block (22) being slidably engaged with said guide receive projections (82) of said male connector housing (28), respectively.

Further, the locking means comprises: a plurality of flexible locking levers (74) formed on the outer surfaces of said male coupling block (22), respectively so as to extend in the engagement direction between both; a plurality of locking projections (83) formed on an inner surface of each of said male connector housings (23), respectively; and said flexible locking levers (74) of said male coupling block (22) being engaged with the locking projections (83) of said male connector housings (23), respectively.

Further, in another embodiment of the present invention, the high density multi-pole connector further comprises housing coupling means for further coupling said two male connector housings (23) with each other, said means comprising: a rail projection (78) formed on one side surface of each of said male connector housings (23) so as to extend in a direction perpendicular to the engagement direction between said male coupling block (22) and said male connector housings (23); and an engage groove (79) formed in an inner surface of each of said male connector housings so as to be engaged with said rail projection of said male connector housing.

Further, in another embodiment of the present invention, the high density multi-pole connector further comprises another locking means (95, 92, 93, 97) for locking said two male connector housings (23) with each other and further said two locked connector housings with said male coupling block (22) in a direction perpendicular to the engagement direction between said connector housings and said coupling block.

Here, the another locking means comprises: a pin insertion hole (93) formed in each of said male connector housings (23); a guide projection plate (100) having cutout portions (97) at both ends thereof and formed on an inner surface of each of said connector housings; another pin insertion hole (92) formed in each side surface of said male coupling block (22), respectively; and a plurality of locking pin assemblies (94) each inserted, through said pin insertion hole (93) of said connector housing and the cutout portions of said guide projection plate of said adjoining connector housing, into said pin insertion holes (92) of said male coupling block (22).

Further, still another embodiment of the high density multi-pole connector further comprises connector housing locating means formed in each of said connector housings, which comprises: a guide projection plate (96) formed in an inner surface of each of said male connector housings (23); and a guide groove (98) formed in a side surface of each of said male connector housings (23) so as to be engaged with said guide projection of said adjoining connector housing, respectively.

Further, the second aspect of the present invention provides a high density mu].ti-pole connector comprising: a male connector (21) formed with a plurality of terminal accommodating chambers; a female connector (41) composed of a plurality of separate female connector housings (43) each formed with a plurality of terminal accommodating chambers; a coupling block (42) for coupling a plurality of the separate female connector housings (43) of said female connector integral with one another; coupling means (49) provided for both said separate female connector housings (43) and said coupling block (42) respectively, for removably coupling said coupling block with the separate female connector housings (43) in an engagement direction between both; and mechanical fastening means (34, 55) provided for both said male connector (21) and said coupling block respectively, for fastening said coupling block to said male connector.

Here, the coupling means (49) comprises: slidable engaging means (50, 52, 58) provided for both said coupling block (42) and said female connector housings (43), for slidably engaging said coupling block (42) with said female connector housings (43), respectively; and locking means (51, 53, 61) provided for both said coupling block (42) and said female connector housings, for locking said coupling block (42) with said female connector housings, respectively.

Further, the slidable engaging means comprises: a plurality of slide grooves (50) formed in two opposing outer surfaces of said coupling block, respectively so as to extend in an engagement direction between said coupling block and said female connector housings; a plurality of engage walls (52) also formed on the two opposing outer surfaces of said coupling block, respectively so as to extend in the engagement direction between both; a plurality of arms (58) formed on an inner surface of each of said female connector housings (43), respectively so as to extend in the engagement direction between both, said arms (58) being slidably engaged with said slide grooves (50) in contact with said engage walls, respectively.

Further, the locking means comprises: a plurality of flexible locking levers (51) each formed with a projection at each free end thereof and formed on two opposing outer surfaces of said coupling block (42), respectively so as to extend in the engagement direction between both; a plurality of stopper plates (53) formed at both ends of a bottom surface of said coupling block (42), respectively; a plurality of arms (58) each formed with a locking hole (61) at an end thereof and formed on an inner surface of each of said female connector housings (43), respectively so as to extend in the engagement direction between both; and the projections of said flexible locking levers (51) of said coupling block (42) being engaged with the locking holes (61) of said arms (58) of said female connector housings (43) and end surfaces of said arms of said female connector housings being brought into contact with said stopper plates (53) of said coupling block (42), respectively.

In the high density multi-pole connector according to the present invention, since the connector housing coupling means (28, 49) are provided on the outer side surfaces of the coupling block (22, 42) and on the outer side surface of the connector housing (23, 43) respectively, it is possible to freely change the outer dimensions of the connector housings or to freely increase and decrease the number of the terminals arranged within the single connector housing.

In this case, when the size of the connector housing is reduced or when no connector housing is coupled to the coupling block, since the size or the outer dimensions of the connectors can be reduced to that extent, it is possible to eliminate the wasteful space or to use the space more effectively. Further, when the size of the connector housings can be reduced, it possible to automate the insertion of the terminals into the connector housings.

Further, since the coupling block can be engaged with the connector housings on the basis of sliding engagement between both, it is possible to facilitate the coupling work of the coupling block with the connector housings.

Further, in the high density multi-pole connector according to the present invention, since the housing coupling means (78, 79) for further coupling the two adjoining connector housings with each other in the direction perpendicular to the engagement direction between both, it is possible to further stably engage the coupling block with the connector housings simply without need of any other parts or tools.

Further, in the high density multi-pole connector according to the present invention, since the other locking means (95, 92, 93, 97) for locking the two adjoining connector housings with each other and further the two locked adjoining connector housings with the coupling block in the direction perpendicular to the engagement direction between both, it is possible to further firmly engage the coupling block with the connector housings simply without need of any other parts or tools.

With the foregoing and other objects, advantages, and features of the invention that will become hereinafter apparent, the nature of the invention may be more clearly understood by reference to the following detailed description of the invention, the appended claims, and the various views illustrated by the drawings.

DETAILED DESCRIPTION OF THE PREFERRED EMBODIMENTS

A first embodiment of the high density multi-pole connector according to the present invention will be described hereinbelow with reference to FIGS. 1 to 7.

Figure 1:
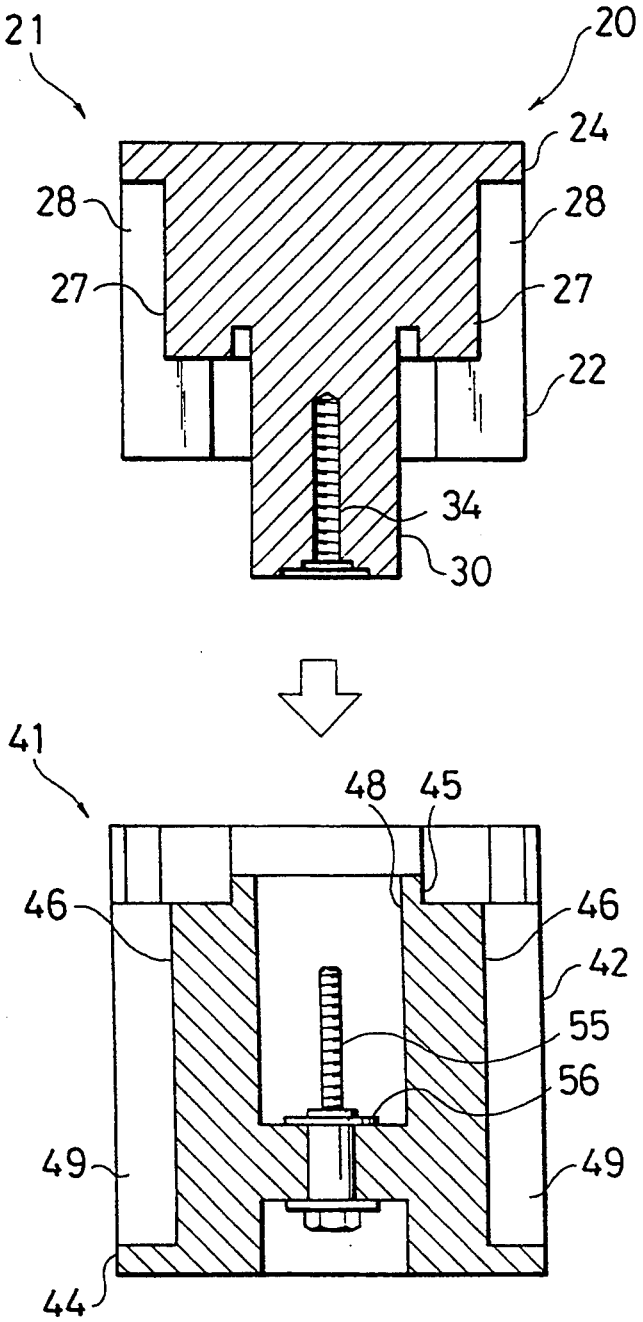
FIG. 1 a side cross-sectional view showing two opposed male and female connectors of a first embodiment of the high density multi-pole connector according to the present invention.
Figure 2:
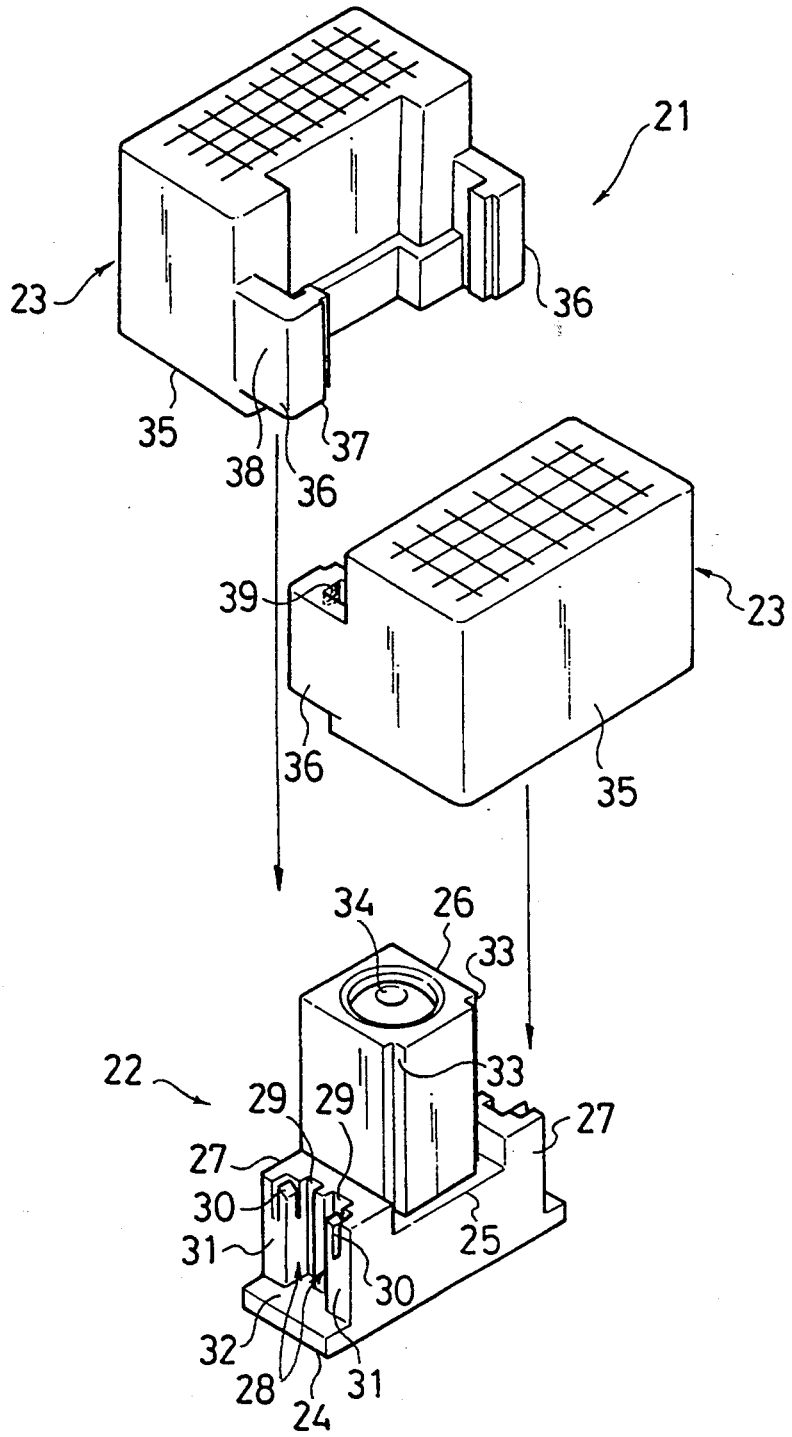
FIG. 2 is a perspective exploded view showing a male connector of the first embodiment of the high density multi-pole connector according to the present invention.

As shown in FIG. 1, a high density multi-pole connector 20 according to the present invention is composed of a male connector 21 and a female connector 41 both coupled to each other. Further, as shown in FIG. 2, the male connector 21 is composed of a single male coupling block 22, and any given number of male connector housings 23. In this embodiment as shown in FIG. 2, the number of the male connector housings 23 to be coupled to the male coupling block 22 is two.

In FIG. 2, coupling means 28 for coupling the coupling block 22 to the male connector housings 23 to one another are provided for both the separate male connector housings 23 and the coupling block 22, respectively. The coupling means 28 can be divided into slidable engaging means composed of slide grooves 29 and engage walls 31 (of the coupling block 22) and arms 36 (of the connector housings 23) and locking means composed of flexible locking levers 30 and stopper plates 32

(of the coupling block 22) and locking holes 39 (of the connector housings 23).

In more detail, the male coupling block 22 is formed with a rectangular base plate 24 and a square pillar boss portion 26. The rectangular base plate 24 has a stepped portion 25 at the middle portion thereof, from which the square pillar boss portion 26 projects or stands. The boss portion 26 is formed with two guide walls 27 on both sides thereof. The coupling means 28 is arranged on each side surface of the coupling block 22 to couple the coupling block 22 to one of the male connector housings 23. Further, the coupling means 28 is formed with two slide grooves 29 extending in parallel in the longitudinal direction of the boss portion 26 and with two engage walls 31 each having a flexible locking lever 30 on an inner surface thereof, respectively. Further, pairs of the slide grooves 29, the locking levers 30 and the engage walls 31 are all arranged in parallel to each other symmetrically along the transverse direction of the coupling block 22. Further, the end of the base plate 24 projects from each guide wall 27 so as to serve as a stopper plate 32, with which an end surface of an arm 36 of the male connector housing 23 is brought into contact, whenever the male connector housing 23 is coupled to the male coupling block 22. Further, the square pillar boss portion 26 is formed with two locating cutouts 33 at two corners thereof so as to prevent the erroneous connection with the female connector 41.

With reference to FIG. 1 again, a nut 34 (mechanical fastening means) is insertion molded at the end surface of the boss portion 26 of the male coupling block 22 on the side of the female connector 41.

On the other hand, as shown in FIG. 2, each male connector housing 23 is composed of a box-shaped connector body 35 formed with a plurality of terminal accommodating chambers (not shown) and a pair of arms 36 on both ends of one side surface of the connector body 35. The arm 36 is formed into an L shape composed of a base wall 38 and an end wall 37, respectively. The two end walls 37 are formed on both ends of an inner side surface of the connecting body 35 so as to extend both inward opposingly. The free ends of the end walls 37 of the male connector housing 23 are slidably engaged with the two slide grooves 29 of the male coupling block 22. On the other hand, the inner surfaces of the end walls 37 of the male connector housing 23 are slidably brought into contact with the inner surfaces of the engage walls 31 of the male coupling block 22. In summary, the slide grooves 29 and the engage walls 31 of the male coupling block 22 and the arms 36 of the male connector housing 23 constitute the slidable engaging means.

Figure 4:
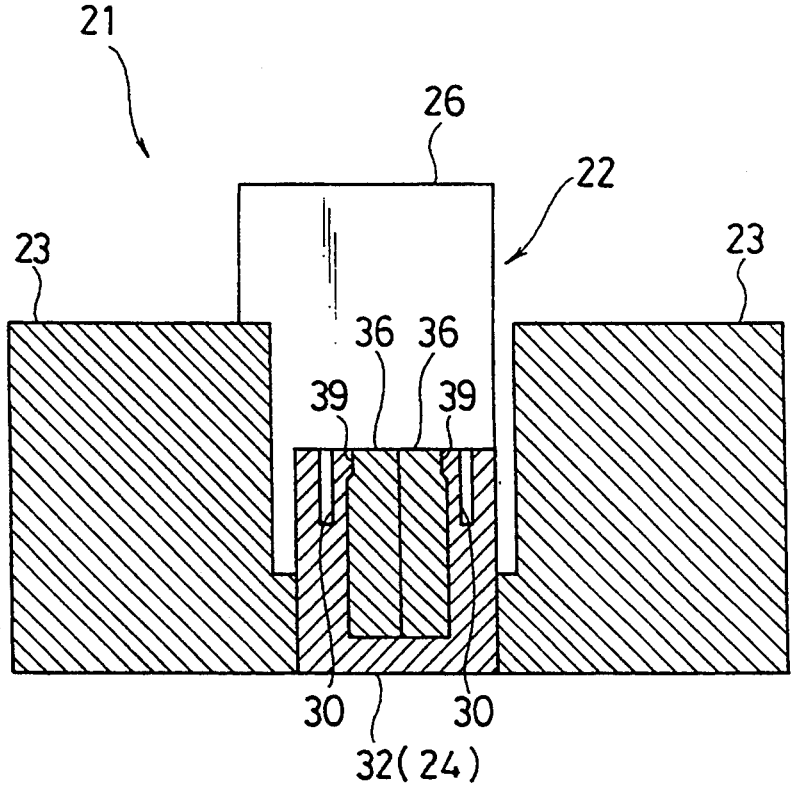
FIG. 4 is a cross-sectional view taken along the line IV—IV shown in FIG. 3.

Further, the arm 36 is formed with a locking hole 39 (see FIG. 2) in the inner surface thereof so as to be locked with an end projection of the flexible locking lever 30 of the male coupling block 22 as shown in FIG. 4. In summary, the flexible lock levers 30 and the stopper plates 32 of the coupling block 22 and the locking holes 39 of the connector housing 23 constitute the locking means. Here, the arms 36 are slidably engaged with the engage walls 31 in such a way that each engage wall 31 is enclosed by the inner side surface of each arm 36, respectively, with the result that it is possible to connect the male connector housing 23 with the male coupling block 22 tightly.

Figure 5:
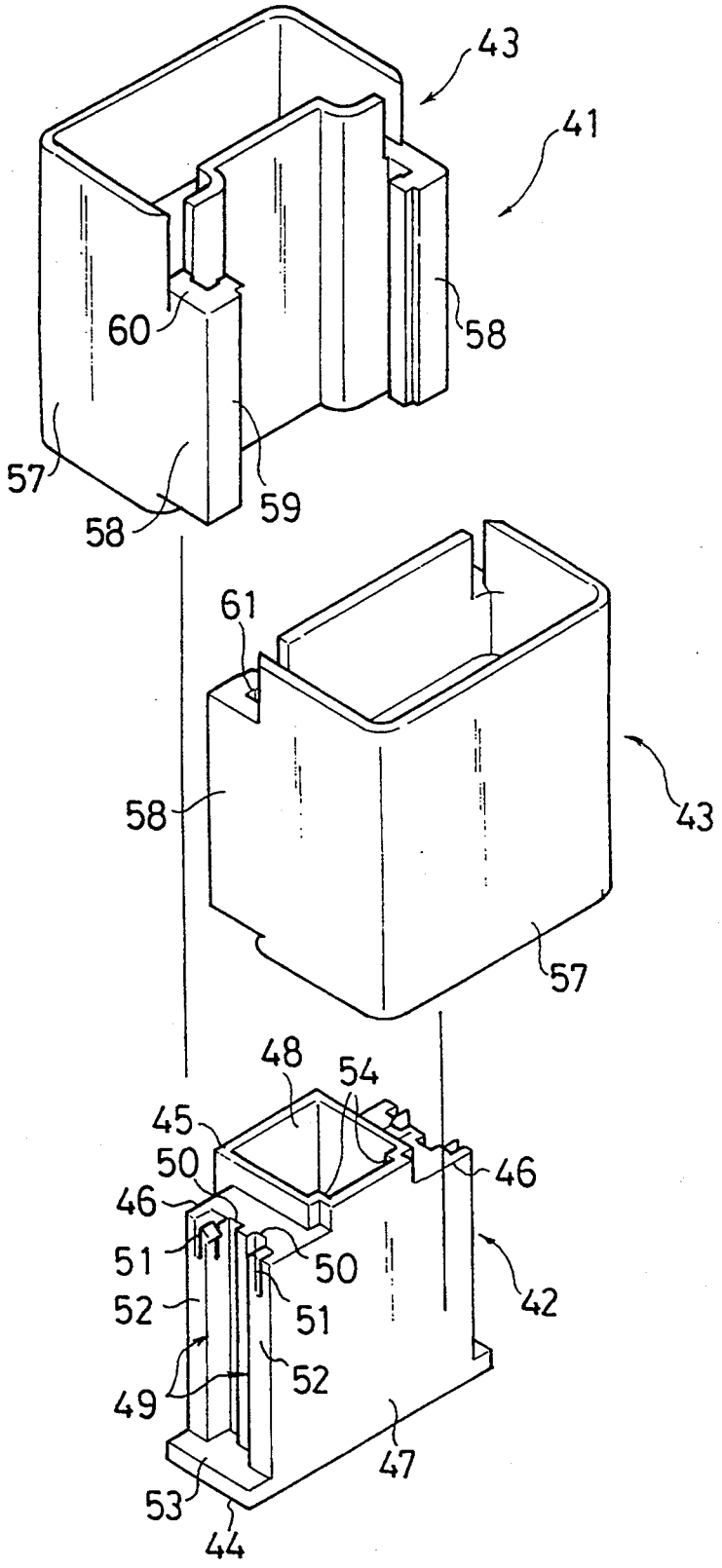
FIG. 5 is a perspective exploded view showing a female connector of the first embodiment according to the present invention.

The female connector housing 41 is described hereinbelow with reference to FIGS. 5 to 7. The female connector 4 is composed of a single female coupling block 42, and any given number of female connector housings 43. In this embodiment as shown in FIG. 5, the number of the female connector housings 43 to be coupled to the female coupling block 42 1s two in correspondence to the number of the male connector housings 23 of the male connector 21.

In the same way, the coupling means 49 for coupling the coupling block 42 to the female connector housings 43 are provided for both the separate female connector housings 48 and the coupling block 42, respectively. The coupling means 49 can be divided into slidable engaging means composed of slide grooves 50 and engage walls 52 (of the coupling block 42) and arms 58 (of the connector housings 48) and locking means composed of flexible locking levers 51 and stopper plates 58 (of the coupling block 42) and locking holes 61 (of the female connector housings 43).

In more detail, the coupling block 42 is formed with a rectangular base plate 44, a boss receive portion 45 and coupling means 49. The boss receive portion 45 is a square holes 48, into which the square pillar boss portion 28 is fitted. The coupling means 49 is arranged on each side surface of the coupling block 42 to couple the coupling block 42 to one of the female connector housings 43. Further, the coupling means 49 is formed with two slide grooves 50 extending in parallel in the longitudinal direction of the boss receive portion 45 and with two engage walls 52 each having a flexible blocking lever 51 on an inner surface thereof, respectively. Further, pairs of the slide grooves 50, the locking levers 51 and the engage walls 52 are all arranged in parallel to each other symmetrically along the transverse direction of the coupling block 42. Further, the end of the base plate 44 projects from each side wall 47 so as to serve as a stopper plate 58, with which an end surface of an arm 58 of the female connector housing 48 is brought into contact, whenever the female connector housing 48 is coupled to the coupling block 42. Further, the square boss receive portion 45 is formed with two locating cutouts 54 at two corners thereof so as to prevent the erroneous connection with the male connector 21.

With reference to FIG. 1 again, a bolt 55 (mechanical fastening means) is passed through a bottom wall of the square hole 48 of the boss receive portion 45 of the coupling block 42 so as to project into the square hole 48. This bolt 55 is supported by a removal prevention mechanism 56 so as to be rotated.

Figure 6:
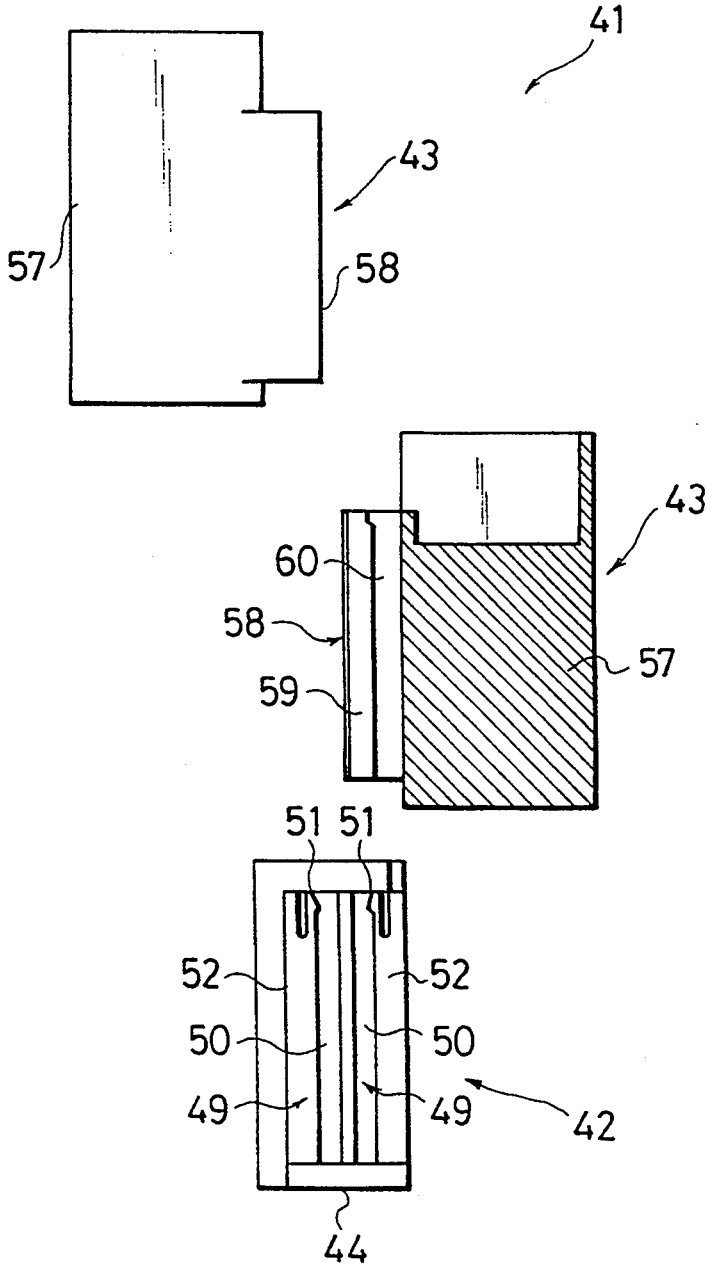
FIG. 6 is a fragmentary exploded cross-sectional view showing the female connector of the first embodiment according to the present invention.
Figure 7:
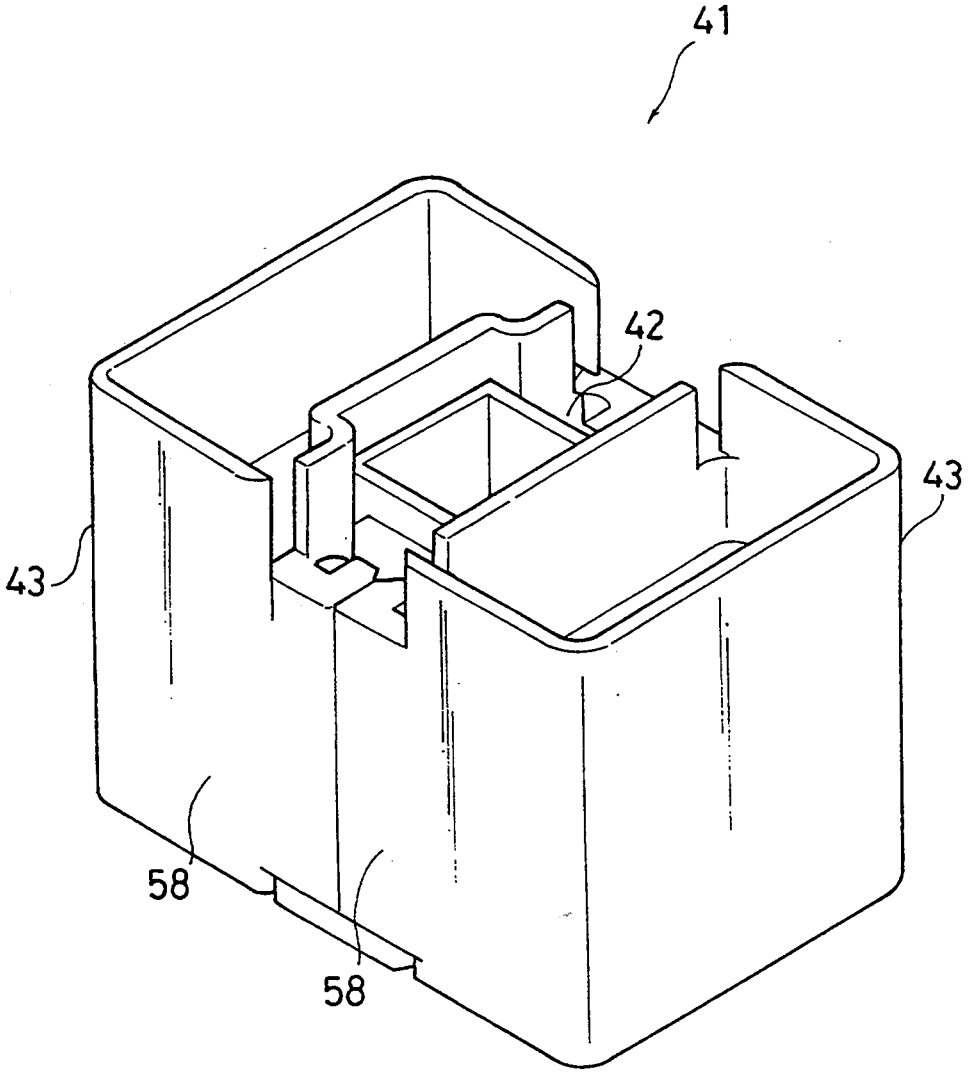
FIG. 7 is a perspective view showing the coupled female connector of the first embodiment according to the present invention.

On the other hand, as shown in FIGS. 5, 6 and 7, each female connector housing 43 is composed of a box-shaped connector body 57 formed with a plurality of terminal accommodating chambers (not shown) and a box-shaped hood (cover) (not shown), and a pair of arms 58 on both ends of one side surface of the connector body 57.

The arm 58 is formed into an L shape composed of a base wall 60 and an end wall 59, respectively. The two end walls 59 are formed on both ends of an inner side surface of the connecting body 57 so as to extend both inward. The free ends of the end walls 59 of the female connector housing 43 are slidably engaged with the two slide grooves 50 of the coupling block 42. On the other hand, the inner surfaces of the end walls 59 of the female connector housing 43 are slidably brought into contact with the inner surfaces of the engage walls 52 of the female coupling block 42. In summary, the slide grooves 50 and the engage walls 52 of the female coupling block 42 and the arms 58 of the female connector housing 43 constitute the slidable engaging means.

Further, the arm 58 is formed with a locking hole 61 (see FIG. 5) in the inner surface thereof so as to be locked with the projection of the flexible locking piece 51 of the female coupling block 42 as shown in FIG. 5 and 6. In summary, the flexible lock levers 51 and the stopper plates 53 of the female coupling block 42 and the lock holes 61 of the female connector housing 43 constitute the locking means. Here, the arms 58 are slidably engaged with the engage walls 52 in such a way that each engage wall 52 is enclosed by the inner side surface of each arm 58, respectively, with the result that it is possible to connect the female connector housing 43 with the coupling block 42 tightly.

In assembly of the male connector 21, after the male terminals (not shown) have been inserted into the male connector housing 23, the two arms 36 of the male connector housing 23 are engaged with the four slide grooves 29 and the four engage wall 31 all formed on both the outer side surfaces of the male coupling block 22 and further slid therealong so that the arms 36 can be fitted to the coupling means 28, with the result that the male connector housing 23 can be coupled with the male coupling block 22.

Figure 3:
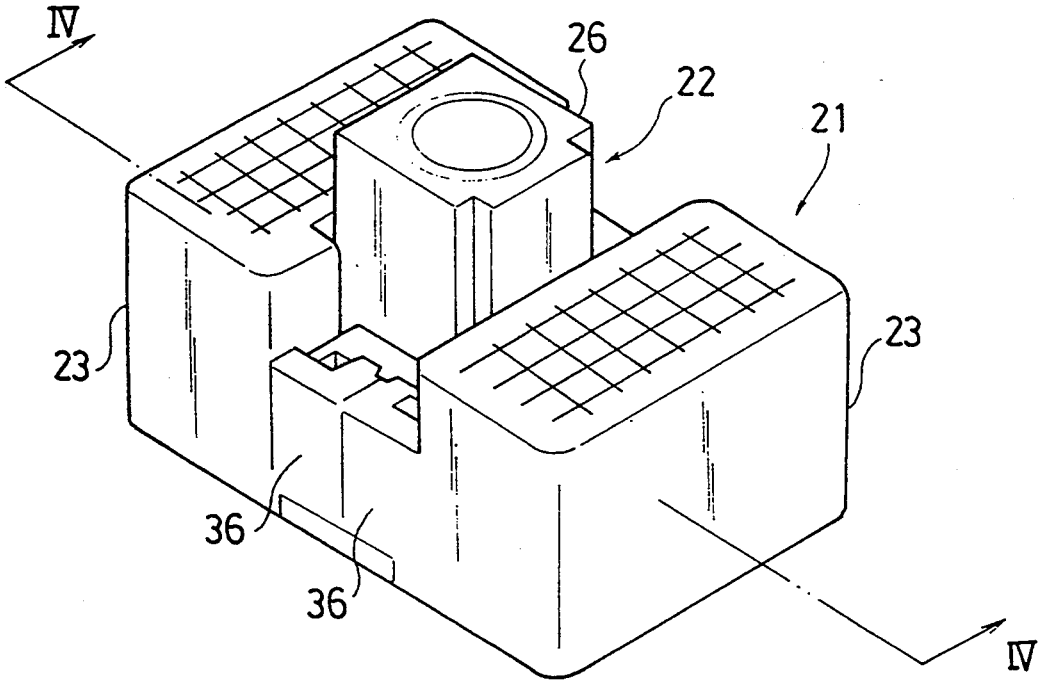
FIG. 3 is a perspective view showing the coupled male connector of the first embodiment according to the present invention.

When the flexible locking levers 30 are engaged with the locking holes 39 and further the male connector housing 23 is brought into tight contact with the two stopper plates 32 of the base plate 24, the male connector housing 23 is locked to the male coupling block 22. Therefore, when the two male connector housings 23 are engaged with the male coupling block 22, it is possible to obtain a male connector 21 in which the two male connector housings 23 are coupled to each other via the male coupling block 22, as shown in FIG. 3.

Under the assembled condition, as shown in FIG. 4, since the arms 36 of the male connector housing 23 are in contact with the stopper plates 32 (the base plate 24) of the male coupling block 22 and in addition the flexible lock levers 30 of the coupling means 28 are engaged with the locking holes 39 of the arms 36 of the male connector housing 23, it is possible to firmly couple the two male connector housings 23 via the male coupling block 22, respectively.

In the same way, in assembly of the female connector 41, after the female terminals (not shown) have been inserted into the female connector housing 43, the two arms 58 of the female connector housing 43 are engaged with the four slide grooves 50 and the four engage wall 52 all formed on both the outer side surfaces of the coupling block 42 and further slid therealong so that the arms 58 can be fitted to the coupling means 49; that is, the female connector housing 43 can be coupled with the coupling block 42.

When the flexible locking levers 51 are engaged with the locking holes 61 and further the female connector housing 43 is brought into tight contact with the stopper plates 32 of the base plate 24, the female connector housing 43 is locked to the coupling block 42. Therefore, when the two female connector housings 43 are coupled with the female coupling block 42, it is possible to obtain a female connector 41 in which the two female connector housings 43 are coupled to each other via the female coupling block 42, as shown in FIG. 7.

Under the assembled condition, since the arms 58 of the female connector housing 43 are in contact with the stopper plates 53 (the base plate 44) of the female coupling block 42 and in addition the flexible lock levers 51 of the female coupling block 42 are engaged with the locking holes 61 of the arms 58 of the female connector housing 43, it is possible to firmly coupled the two female connector housings 43 via the female coupling block 42, respectively.

Further, after the male connector 21 and the female connector 41 have been both assembled, as shown in FIG. 1 the male coupling block 22 and the female coupling block 42 are opposed to each other; the male boss portion 26 is fitted into a square hole 48 of to the boss receive portion 45; and then the bolt 55 and the nut 34 are screwed with each other. With the advance of the fastening of the bolt and the nut, the male connector housing 23 and the female connector housing 43 are both fitted to each other, with the result that the male connector 21 and the female connector 41 are connected to each other electrically.

In the above-mentioned embodiment, it should be noted that it is possible to connect any given size of the male and female connector housings 23 and 43 with the use of the male and female coupling blocks 22 and 42 as common coupling means.

Figure 8A:
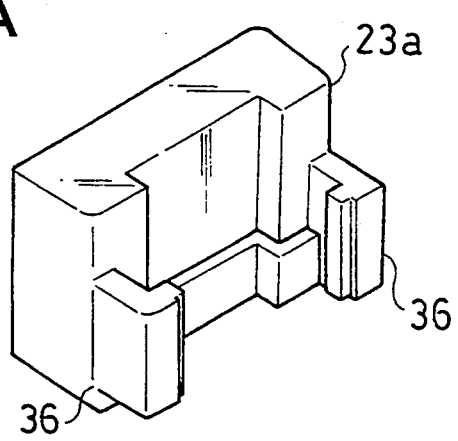
FIG. 8A is a perspective view of a male connector housing for a small number of terminals.
Figure 8B:
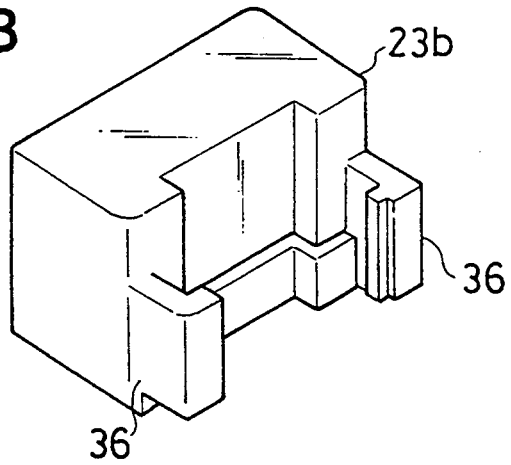
FIG. 8B is a perspective view of a male connector housing for a medium number of terminals.
Figure 8C:
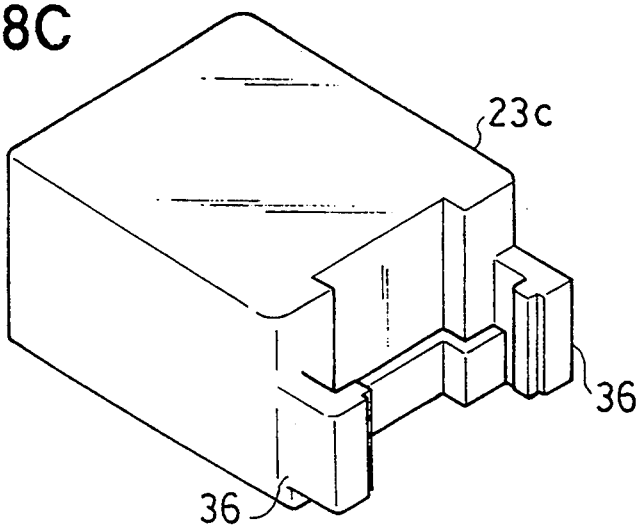
FIG. 8C is a perspective view of a male connector housing for a large number of terminals.

In more detail, as shown in FIGS. 8A to 8C, as far as the size of the arms 36 are determined to be constant dimensions, it is possible to connect various sized (small, medium and large) male connector housings **23*a*, 23*b* and 23*c* of different number of terminals with the use of the same male coupling block 22**, for instance as occasion demands. In other words, it is possible to assemble various sorts of connectors of different number of terminals by changing only the connector housings of various sizes at need by the common coupling block.

Further, when the male connector housings **23*a* of small number of terminals are coupled, the outer dimensions of the whole male connector 21 can be reduced. In particular, when only a single connector housing is connected to the male coupling block 22, since the side on which no connector housing is coupled becomes an empty space, it is possible to minimize the connector size, without occupying a wasteful space. In addition, since the coupling blocks 22 and 42** having the bolt and nut, respectively can be used in common, it is possible to reduce the manufacturing cost of the connectors.

Further, since the number and the arrangement of the terminals can be determined freely in all the male and female connector housings 23 and 43, it is possible to minimize and standardize the sizes of the male and female connector housings 23 and 43 so as to be suitable for an automatic connector terminal insertion system.

A second embodiment of the high density multi-pole connector according to the present invention will be described hereinbelow with reference to FIGS. 9 to 12, in which the same reference numerals have been retained for the similar parts or elements which have the same functions as with the case of the first embodiment shown in FIGS. 1 to 7. Further, in this embodiment, only the male connector 71 will be described hereinbelow, because the female connector is substantially the same in construction as the male connector 71.

In this second embodiment, the male connector 71 is composed of a single male coupling block 22 and four male connector housings 23, and the two adjoining male connector housings 23 are slidably engaged with each other. In addition, in this embodiment, housing coupling means for coupling two adjoining connector housings 23 with each other is further provided in the direction perpendicular to the engagement direction between the coupling block 22 and the connector housings 23. The housing coupling means is composed of a rail projection 78 formed on one side surface of each of the connector housing and an engage groove 79 formed in an inner surface of each of the connector housing.

Figure 9:
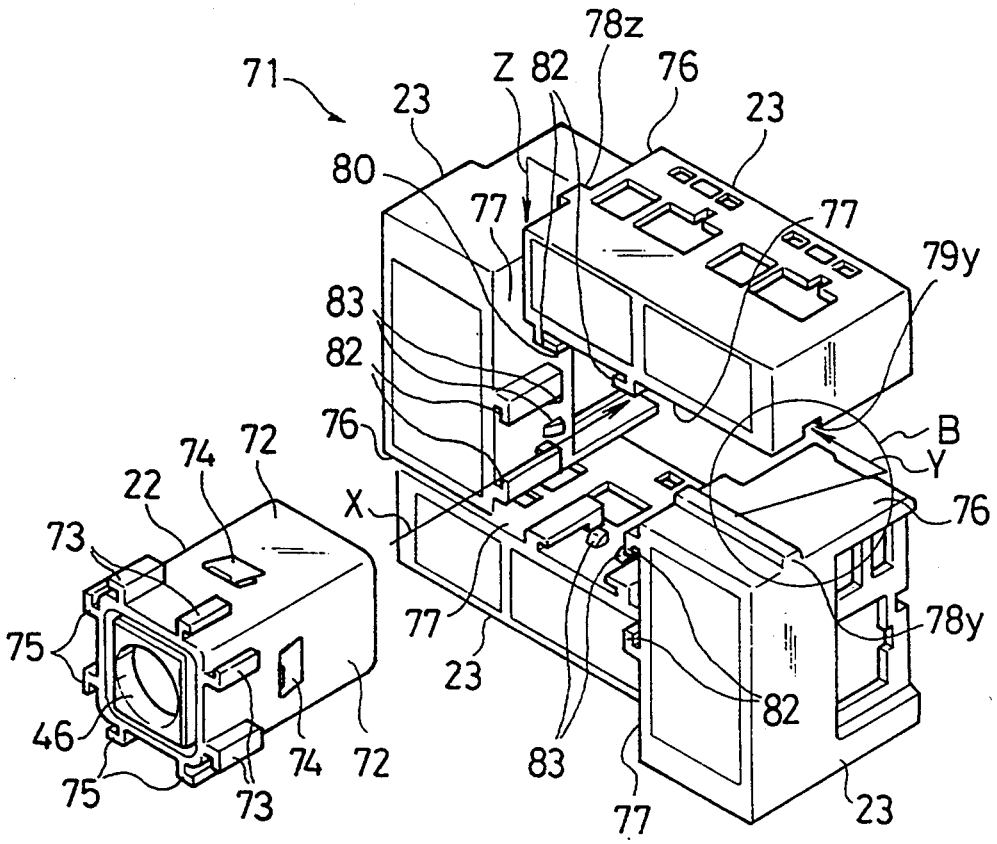
FIG. 9 is a perspective exploded view showing a male connector of a second embodiment of the high density multi-pole connector according to the present invention.

In more detail, as shown in FIG. 9, the male coupling block 22 is formed into a roughly a box-shaped body formed with four side walls 72 on each of which coupling means is provided. The coupling means is composed of two guide blocks 73 and a flexible locking lever 74. The guide blocks 73 are two projections extending in the longitudinal direction of the male coupling block 22, and each projection is formed into an L shape in cross section in such a way that an end thereof is bent outward. Further, a nut 46 formed with a screw hole is insertion molded together with the male coupling block 22.

Figure 10:
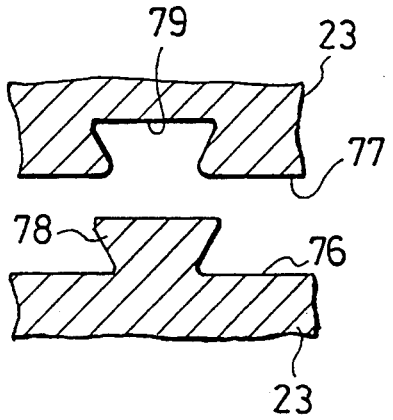
FIG. 10 is an enlarged cross-sectional view showing the dovetail projection and groove indicated by a circle B shown in FIG. 9.

Each male connector housing 23 is also formed into roughly box shape. On two perpendicular adjoining outer side surfaces 76 and 77 of each of the male connector housings 23 (see the top male connector housing 23, in FIG. 9), a rail projection 78*z* extending (on the surface 76) in the z-axis direction and an engage groove 79*y* extending (on the surface 77) in the y-axis direction are formed as housing coupling means. The rail projection 78 and the engage groove 79 are both formed into dovetail shape as shown in FIG. 10 so as to be slidably movable engaged relative to each other in the extending direction.

Further, in FIGS. 9 to 12, the suffix y or z attached to the rail projections 78 and the engage grooves 79 indicates the y-axis or z-axis direction, in FIG. 9.

Figure 11:
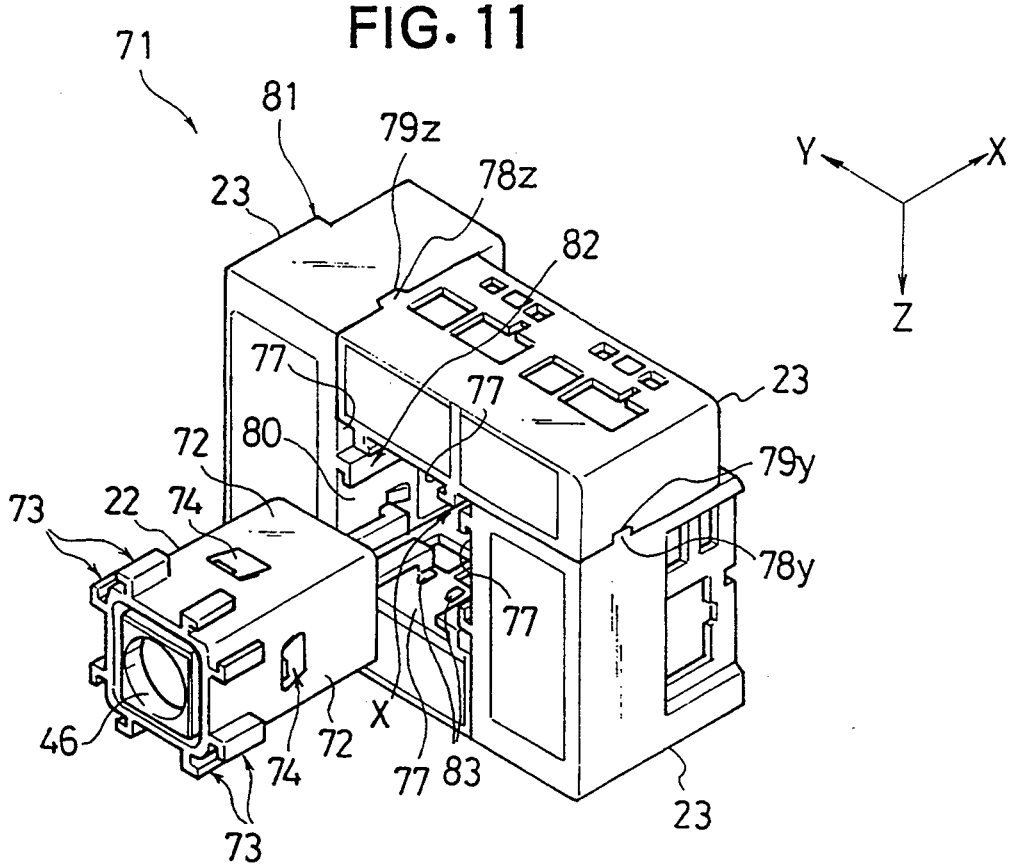
FIG. 11 is a perspective exploded view showing a male connector of the second embodiment of the high density multi-pole connector according to the present invention.

Accordingly, when the four male connector housings 23 can be slidably coupled with each other, by engaging the rail projection 78*y* of the male connector housing 23 (the right side housing in FIG. 9, for instance) with the engage groove 79*y* of the male connector housing 23 (the top male connector housing 23 in FIG. 9, for instance). When the four connector housings are engaged with each other completely, it is possible to obtain a roughly square-shaped housing assembly 81 having a central hollow portion 80, as shown in FIG. 11, into which the male coupling block 22 can be inserted in the x-axis direction in FIGS. 9 and 11. Here, the x-axis direction is the direction that the male coupling block 22 is removably coupled with the connector housing assembly 81. In this embodiment, since the directions of the rail projection 78(*z*) and the engage groove 79(*y*) are both perpendicular to the coupling direction x of the male coupling block 22, it is possible to insert the male coupling block 22 into the connector housing assembly 81, after the four connector housings 23 have been assembled.

In addition, each male connector housing 23 is provided with coupling means composed of two guide receive projections 82 and two locking projections 83. The guide receive projections 82 extend in the insertion direction of the male coupling block 22 into the hollow portion 80, and each projection is formed into an L-shape in cross section in such a way that an end thereof is bent inward, respectively. The guide receive projections 82 are slidably engaged with the guide blocks 73 of the male coupling block 22 and the locking projections 83 are locked with the flexible locking lever 74 of the male coupling block 22. In other words, the guide blocks 73 and the guide receive projections 82 constitute the slidable engaging means, and the flexible locking lever 74 and the locking projections 83 constitute the locking means.

Further, as shown in FIG. 11, the guide receive projection 82 and the locking projections 83 are formed on the inner surfaces of the male connector housings 23 so as to be located within the hollow portion 80 and at such positions as to be engaged with the guide blocks 73 and the flexible locking lever 74 of the male coupling block 22, respectively.

Figure 12:
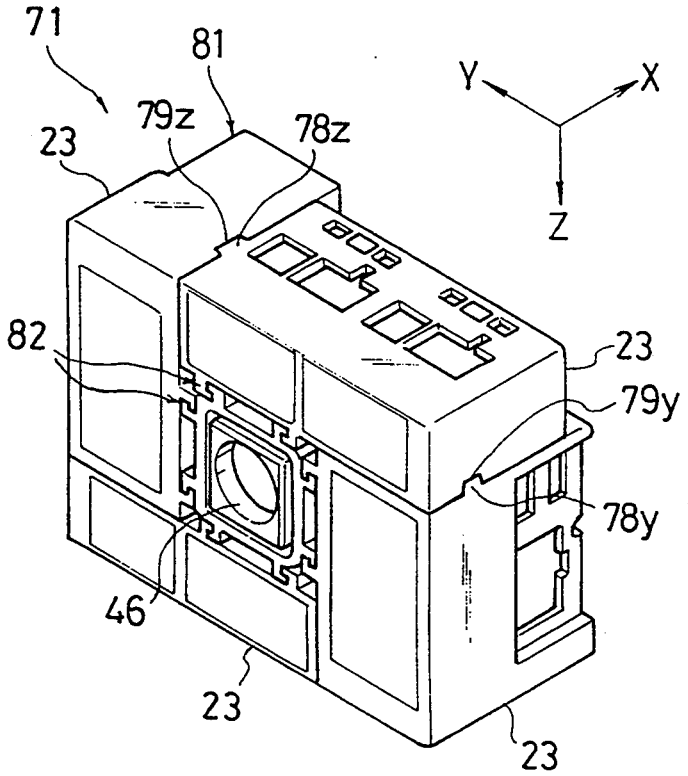
FIG. 12 is a perspective view showing the coupled male connector of the second embodiment according to the present invention.

In assembly of the male connector 71, after the terminals (not shown) have been inserted into the male connector housings 23, a connector housing assembly 81 as shown in FIG. 12 can be obtained by engaging the rail projections 78 of the male connector housings 23 with the engage grooves 79 of the male connector housings 23 extending in both the y-axis and z-axis directions in FIGS. 9 and 11. Thereafter, the male coupling block 22 is inserted into the central hollow portion 80 of the connector housing assembly 81 in the x-axis direction by slidably engaging the guide blocks 73 of the male coupling block 22 with the guide receive projections 82 of the male connector housings 23, until the flexible locking levers 74 of the male coupling 22 can be locked with the locking projections 83 of the male connector housings 23, respectively. Under these conditions, it is possible to obtain a male connector 71, as shown in FIG. 12, in which the four male connector housings 23 are coupled to each other via the single male coupling block 22.

In this second embodiment, since the rail projections 78 are slidably engaged with the engage grooves 79 in the y-axis or the z-axis direction perpendicular to the x-axis direction in which the male coupling block 22 is assembled with the four male connector housings 23, it is possible to obtain a tight coupling condition of the four male connector housings 23, without being dislocated in the x-axis direction. In other words, it is possible to prevent any one of the male connector housings 23 from being removed from the male connector 71 whenever the male coupling block 22 is inserted into the hollow portion 80 of the connector housing assembly 81. Further, the assembly work can be attained simply without use of any spacial parts and tools.

A third embodiment of the high density multi-pole connector according to the present invention will be described hereinbelow with reference to FIGS. 13 to 15, in which the same reference numerals have been retained for the similar parts or elements which have the same functions as with the case of the first and second embodiments shown in FIGS. 1 to 8. Further, in this third embodiment, only the male connector 91 will be described hereinbelow, because the female connector is substantially the same in construction as the male connector 91.

The feature of this third embodiment is to improve the coupling force between the coupling blocks 73 and the male connector housings 23 and between the connector housings 23 with the use of another locking means, which is composed of a pin insertion hole 93, a guide projection plate 100, another pin insertion hole 92 and locking pin assemblies 94. Further, the connector housing 23 is formed with housing locating means composed of a guide projection 96 and a guide groove 98 both formed in two different side surfaces of each of the connector housing 23.

Figure 13:
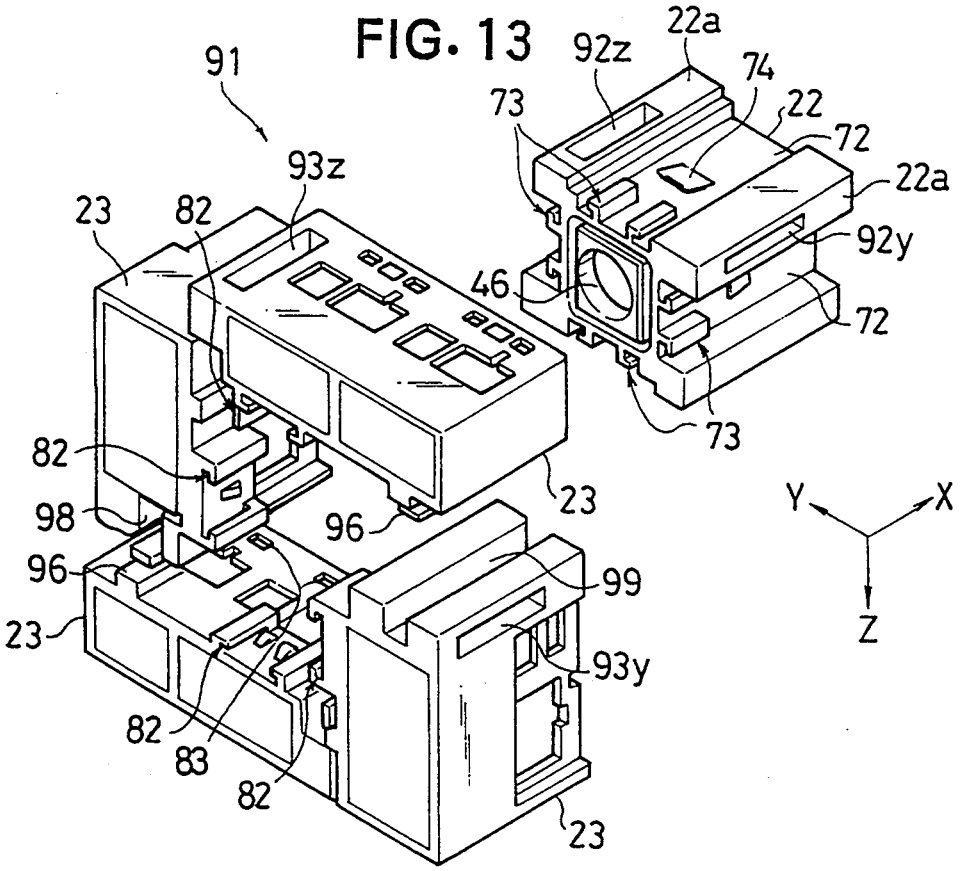
FIG. 13 is a perspective exploded view showing a male connector of a third embodiment of the high density multi-pole connector according to the present invention.

As shown in FIG. 13, the male coupling block 22 is formed with a rectangular pin insertion hole 92, and the connector housing 23 is formed with a similar rectangular pin insertion hole 93. The lock pin insertion directions in the pin insertion holes 93 are the y-axis or z-axis direction perpendicular the x-axis direction that the male coupling block 22 is coupled with the male connector housings 23. Further, in FIGS. 13 to 15, the suffix y or z attached to the pin insertion holes 92 and 93 and the lock pin assemblies 94 indicates the insertion direction in FIGS. 13 to 15.

Figure 14:
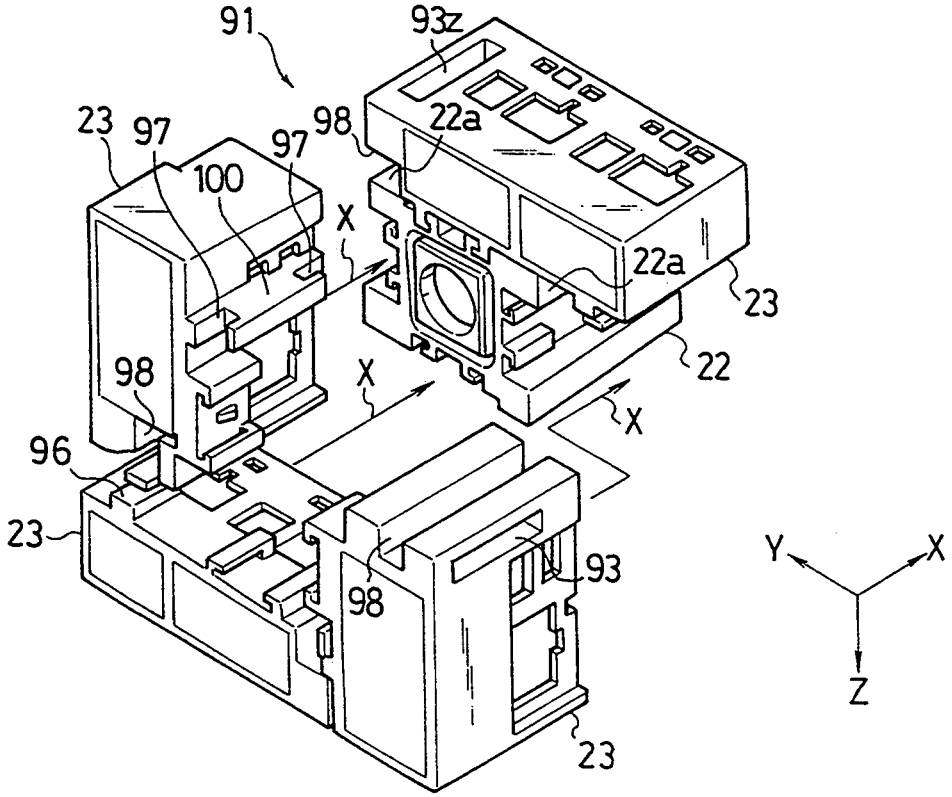
FIG. 14 is another perspective exploded view showing the male connector of the third embodiment of the connector according to the present invention.

As shown in FIG. 14, the male connector housing 23 is formed with a guide projection plate 96 (see the lower male connector housing 23 in FIG. 14, for instance), and a guide groove 98 (see the left male connector housing 23 in FIG. 14, for instance) both extending in the engagement (x-axis) direction of the male coupling block 22 with the male connector housings 23. Therefore, when the guide projection plate 96 of the male connector housing 23 is engaged with the guide groove 98 of the male connector housing 23, it is possible to prevent the erroneous-direction engagement of the two male connector housings 23 relative to the male coupling block 22. Further, two cutout portions 97 are formed on both ends of the guide projection plate 100.

Under the conditions that the male connector housing 23 is engaged with the male coupling block 22, the guide projection plate 100 is located between the pin insertion hole 93 of the male connector housing 23 and the pin insertion hole 92 of the male coupling block 22.

Figure 15:
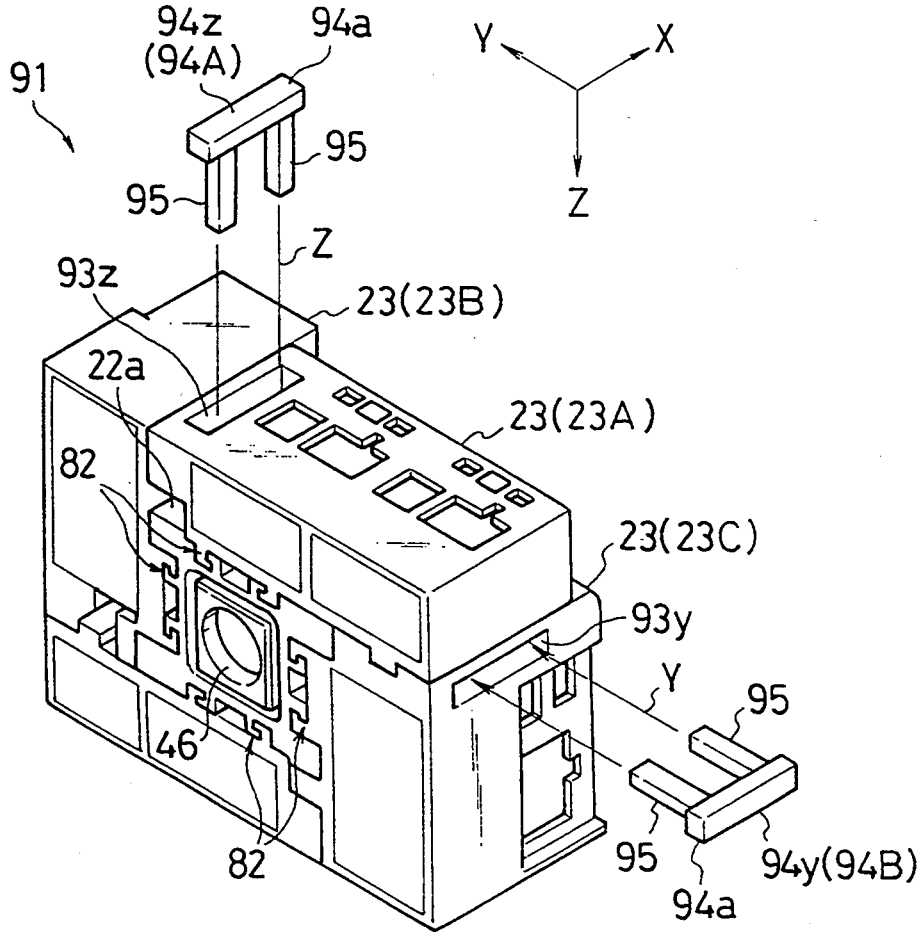
FIG. 15 is a perspective view showing a coupled male connector of the third embodiment according to the present invention.

On the other hand, as shown in FIG. 15, the lock pin assembly 94 is provided with two pins 95 projecting from a head portion 94*a*. Therefore, when the male coupling block 22 is coupled with the male connector housings 23 by engaging the guide blocks 73 (see FIG. 13) with the guide receive projection 82 and further by locking the flexible locking levers 74 with the locking projections 83, both the pin insertion holes 92 and 93 formed in the male coupling block 22 and the male connector housing 23, respectively communicate with each other through the cutout portions 97 (see FIG. 14) formed on both ends of the guide projection plate 100. Accordingly, when the lock pin assembly 94 is inserted from the pin insertion hole 93 toward and into the pin insertion hole 92, the two pins 95 can be passed through the two cutout portions 97 of the guide projection plate 100 of the male connector housing 23 deep beyond the housing contact surface 22*a* of the male coupling block 22, and tightly inserted into the pin insertion hole 92 of the male coupling block 22. Further, under these conditions, the head 94*a* of the lock pin assembly 94 is held within the pin insertion hole 93 of the male connector housing 23 over the upper surface of the guide projection plate 100. Therefore, since the lock pin assembly 94 can be held in the y-axis or z-axis direction perpendicular to the engagement (x-axis) direction of the male coupling block 22 with the male connector housing 23, it is possible to couple the male coupling block 22 and the male connector housing 23 and further two male connector housings 23 all securely and tightly.

In assembly of the male connector 91, after the terminals (not shown) have been inserted into the respective male connector housings 23, as shown in FIG. 14 the guide blocks 73 of the male coupling block 22 are engaged with the guide receive projections 82 of the male connector housings 23 and further the flexible lock levers 74 of the male coupling block 22 are engaged with the locking projections 83 into the locked conditions, so that it is possible to assembly the four male connector housings 23 by a single male coupling block 22, as shown in FIG. 15. Under these assembled conditions, the lock pins 95 are inserted from the pin insertion holes 93 of the male connector housings 23 to complete the male connector 91.

In this embodiment, since the lock pin assemblies 94 are inserted in the y- or z-axis direction perpendicular to the engagement (x-axis) direction of the male coupling lock 22 with the male connector housing 23, it is possible to securely lock the two male connector housings 23 and the male coupling block 22 and the male connector housings 23, respectively. In more detail, with reference to FIG. 15, the upper male connector housing 23A can be locked to the side male connector housing 23B and the male coupling block 22 with the use of the lock pin 94A. Further, the side male connector housing 23C can be locked to the upper male connector housing 23A and the male coupling block 22 with the use of the lock pin 94B. That is, since the male coupling block 22 and the male connector housings 23 can be further engaged with the lock pin assemblies 94 more tightly in such the directions that the two connector housings can be coupled to each other, it is possible to improve the coupling reliability between the connector housings and between the connector housings and the connecting block, thus improving the coupling characteristics against shock or vibration.

As described above, in the high density multi-pole connector according to the present invention, since any required sized connector housings can be coupled to the coupling block, it is possible to provide various types of connectors having a great number of terminals and a small number of terminals with the use of the common coupling block as occasion demands.

Further, when the number of the connector housings is reduced, since the whole outer dimensions can be decreased according thereto, it is possible to eliminate a wasteful space occupied by the connector. Further, when the number of the connector housings is small, the terminal insertion into the connector housings can be automatized.

Further, since the connector housings and the coupling block can be engaged and further locked with one another in accordance with only the sliding engagement, it is possible to facilitate the engagement work between both.

What is claimed is:

1. A high density multi-pole connector comprising:

a male connector having a plurality of separate male connector housings each formed with a plurality of terminal accommodating chambers;

a female connector formed with a plurality of terminal accommodating chambers;

a coupling block for coupling a plurality of the separate male connector housings of said male connector integral with one another;

coupling means provided for both said separate male connector housings and said coupling block respectively, for removably coupling said coupling block with the separate male connector housings in an engagement direction between both; said coupling means including a slidable engaging means provided for both said coupling block and said male connector housings, for slidably engaging said coupling block with said male connector housings, respectively; and locking means provided for both said coupling block and said male connector housings, for locking said coupling block with said male connector housings, respectively;

wherein said locking means includes a plurality of flexible locking levers each formed with a projection at each free end thereof and formed on two opposing outer surfaces of said coupling block, respectively so as to extend in the engagement direction between both;

a plurality of stopper plates formed at both ends of a bottom surface of said coupling block, respectively; and a plurality of arms each formed with a locking hole at an end thereof and formed on an inner surface of each of said male connector housings, respectively so as to extend in the engagement direction between both;

the projections of said flexible locking levers of said coupling block being engaged with the locking holes of said arms of said connector housings and end surfaces of said arms of said connector housings being brought into contact with said stopper plates of said coupling block, respectively, mechanical fastening means provided for both said female connector and said coupling block respectively, for fastening said coupling block to said female connector.

2. The high density multi-pole connector of claim 1, wherein said slidable engaging means comprises:

a plurality of slide grooves formed in two opposing outer surfaces of said coupling block, respectively so as to extend in an engagement direction between said coupling block and said male connector housings;

a plurality of engage walls also formed on the two opposing outer surfaces of said coupling block, respectively so as to extend in the engagement direction between both; and a plurality of arms formed on an inner surface of each of said male connector housings, respectively so as to extend in the engagement direction between both, said arms being slidably engaged with said slide grooves in contact with said engage walls, respectively.

3. The high density multi-pole connector of claim 1, wherein said slide engaging means comprises:

a plurality of guide blocks formed on two opposing outer surfaces of said coupling block, respectively so as to extend in an engagement direction between said coupling block and said male connector housings; and a plurality of guide receive projections formed on an inner surface of each of said male connector housings, respectively so as to extend in the engagement direction between both, said guide blocks of said coupling block being slidably engaged with said guide receive projections of said connector housing, respectively.

4. The high density multi-pole connector of claim 1, further comprising housing coupling means for coupling said plurality of connector housings with each other, said means including:

a rail projection formed on one side surface of each of said connector housings so as to extend in a direction perpendicular to the engagement direction between said coupling block and said connector housings; and an engage groove formed in an inner surface of each of said male connector housings so as to be engaged with said rail projection of said male connector housings.

5. The high density multi-pole connector of claim 1, further comprising another locking means for locking said plurality of connector housings with each other and further said plurality of locked connector housings with said coupling block in a direction perpendicular to the engagement direction between said connector housings and said coupling block.

6. The high density multi-pole connector of claim 5, wherein said another locking means comprises:

a pin insertion hole formed in each of said connector housings;

a guide projection plate having cutout portions at both ends thereof and formed on an inner surface of each of said connector housings;

another pin insertion hold formed in each side surface of said coupling block, respectively; and a plurality of locking pin assemblies each inserted, through said pin insertion hole of said connector housing and the cutout portions of said guide projection plate of said connector housing, into said pin insertion holes of said coupling block.

7. The high density multi-pole connector of claim 1, further comprising connector housing locating means formed in each of said connector housings, including:

a guide projection formed in an inner surface of each of said connector housings; and a guide groove formed in a side surface of each of said connector housings so as to be engaged with said guide projection of said connector housing, respectively.

8. A high density multi-pole connector comprising:

a male connector formed with a plurality of terminal accommodating chambers;

a female connector having a plurality of separate female connector housings each formed with a plurality of terminal accommodating chambers;

a coupling block for coupling a plurality of the separate female connector housings of said female connector integral with one another;

coupling means provided for both said separate female connector housings and said coupling block respectively, for removably coupling said coupling block with the separate female connector housings in an engagement direction between both; said coupling means including slidable engaging means provided for both said coupling block and said female connector housings, for slidably engaging said coupling block with said female connector housings, respectively; and locking means provided for both said coupling block and said female connector housings, for locking said coupling block with said female connector housings, respectively;

wherein said locking means includes a plurality of flexible locking levers each formed with a projection at each free end thereof and formed on two opposing outer surfaces of said coupling block, respectively so as to extend in the engagement direction between both; a plurality of stopper plates formed at both ends of a bottom surface of said coupling block, respectively; and a plurality of arms each formed with a locking hole at an end thereof and formed on an inner surface of each of said female connector housings, respectively so as to extend in the engagement direction between both; wherein the projections of said flexible locking levers of said coupling block being engaged with the locking holes of said arms of said female connector housings and end surfaces of said arms of said female connector housings being brought into contact with said stopper plates of said coupling block, respectively; and mechanical fastening means provided for both said male connector and said coupling block respectively, for fastening said coupling block to said male connector.

9. The high density multi-pole connector of claim 8, wherein said slidable engaging means comprises:

a plurality of slide grooves formed in two opposing outer surfaces of said coupling block, respectively so as to extend in an engagement direction between said coupling block and said female connector housings;

a plurality of engage walls also formed on the two opposing outer surfaces of said coupling block, respectively so as to extend in the engagement direction between both; and a plurality of arms formed on an inner surface of each of said female connector housings, respectively so as to extend in the engagement direction between both, said arms being slidably engaged with said slide grooves in contact with said engage walls, respectively.

* * * * *